US006536189B1

(12) United States Patent
Murray

(10) Patent No.: US 6,536,189 B1
(45) Date of Patent: Mar. 25, 2003

(54) COMPUTERIZED, MONITORED, TEMPERATURE AFFECTED, DELIVERY SYSTEM FOR PERISHABLE GOODS

(75) Inventor: Joseph C. Murray, Mobile, AL (US)

(73) Assignee: Thermal Products, Inc., Encino, CA (US)

( * ) Notice: Subject to any disclaimer, the term of this patent is extended or adjusted under 35 U.S.C. 154(b) by 0 days.

(21) Appl. No.: 09/366,446

(22) Filed: Aug. 3, 1999

(51) Int. Cl.[7] ..... B65B 63/08; B65B 55/20

(52) U.S. Cl. ..... 53/440; 53/449; 53/472; 53/474

(58) Field of Search ..... 53/440, 449, 472, 53/419, 474, 484, 507, 127, 136.4, 139.5, 175, 415, 445; 206/204, 545, 584, 522, 521, 459.1; 426/109, 393, 396; 62/60, 372; 705/1, 26; 700/216; 229/118, 905, 125.39

(56) References Cited

U.S. PATENT DOCUMENTS

| | | | | | |
|---|---|---|---|---|---|
| 2,149,412 | A | * | 3/1939 | Bangs | 62/60 |
| 2,302,639 | A | * | 11/1942 | Moore | 53/440 |
| 2,467,268 | A | * | 4/1949 | Merkle | 62/372 |
| 2,496,731 | A | * | 2/1950 | Longo | 62/60 |
| 3,557,567 | A | * | 1/1971 | Brennan | 426/393 |
| 3,890,762 | A | * | 6/1975 | Ernst et al. | 53/440 |
| 4,000,815 | A | * | 1/1977 | Wingbro et al. | 53/440 |
| 4,294,079 | A | * | 10/1981 | Benson | 62/60 |
| 4,862,674 | A | * | 9/1989 | Lejondahl et al. | 53/440 |
| 4,882,893 | A | * | 11/1989 | Spencer et al. | 53/449 |
| 5,038,283 | A | * | 8/1991 | Caveney | 700/216 |
| RE34,533 | E | * | 2/1994 | Wigley | 53/440 |
| 5,450,948 | A | * | 9/1995 | Beausoleil et al. | 53/472 |
| 5,619,841 | A | * | 4/1997 | Muise et al. | 53/440 |
| 5,628,845 | A | * | 5/1997 | Murray et al. | 156/64 |
| 5,666,493 | A | * | 9/1997 | Wojcik et al. | 705/26 |
| 5,945,147 | A | * | 8/1999 | Borchard | 426/393 |
| 5,966,962 | A | * | 10/1999 | Murray et al. | 62/374 |

FOREIGN PATENT DOCUMENTS

| | | | | | |
|---|---|---|---|---|---|
| CA | 942263 | A | * | 2/1974 | 53/440 |
| WO | WO-94/15841 | A | * | 7/1994 | 53/449 |

* cited by examiner

*Primary Examiner*—Stephen F. Gerrity
(74) *Attorney, Agent, or Firm*—Pugh/Associates; C. Emmett Pugh

(57) ABSTRACT

A "safe delivery"[SM] system for delivering perishable groceries (120/120'), including an inexpensive, corrugated cardboard box (100); a source of cold (or heat as needed) maintaining the temperature inside the box within a desired temperature range for hours, using an all encompassing pouch of packet material (110/10), used individually (FIGS. 2 & 3) or collectively (FIGS. 5 & 6), with each packet (17) containing a super-absorbent polymer (14, FIG. 12) which is hydrated (14', FIG. 12A) and then either frozen (e.g., in a freezer) or heated (e.g., in a microwave), without producing moisture as the polymer returns to its natural state; a protective cover (130) protecting the box and its contents from heat radiation (e.g., sunlight). Other components (e.g., bubble wrap 140, sealing tape 133) prevent heat attacking convection and/or conduction, with the cover having multiple plies with an outer metallized surface (131); a time/temperature monitoring alert (134) indicating when either a maximum predetermine temperature or a maximum allowed, elapsed time from packing to opening has been exceeded. If so, the customer knows that the perishable items are not warranted to be safe, and the customer is responsible for contacting the purveyor for a return of the goods. A computerized methodology (FIG. 1) insures that the purveyor knows at least approximately when the customer has opened the packed groceries, etc., using a predictive calculator and an automated tracking system, in which the customer is obligated to transmit a unique code, preferably through an automated telephonic or Internet system, when the package is opened.

21 Claims, 7 Drawing Sheets

COMPUTERIZED, MONITORED, TEMPERATURE AFFECTED, DELIVERY SYSTEM FOR PERISHABLE GOODS

REFERENCE TO RELATED APPLICATIONS

Reference is hereby made to the co-pending patent application entitled "Hydration and Freezing Plant for Flexible Refrigerant Media" filed Jul. 11, 1997 as Ser. No. 08/893,405, one of the two co-inventors, namely, Messrs. Murray and Gaude, being the inventor hereof, namely, Mr. Murray, now abandoned in favor of patent application entitled "Modular Hydration and Freezing Plant for Flexible Refrigerant Media" filed May 8, 1998 as Ser. No. 09/075,429, also filed by Messrs. Murray and Gaude, being issued as U.S. Pat. No. 5,966,962 on Oct. 19, 1999, and application entitled "Porous, Laminated, Super Absorbent, Hydratable, Temperature Control Pack System" filed May 15, 1998 as Ser. No. 09/079,872 by Messrs. Murray & Gaude and Ms. Gabel, being issued as U.S. Pat. No. 6,269,654 on Aug. 7, 2001, the disclosures of all of which applications also are incorporated herein by reference. Reference is likewise had to U.S. Pat. No. 5,628,845 issued May 13, 1997 entitled "Process for Forming Hydratable, Flexible Refrigement Media" by Murray and Browne, the former being the inventor hereof, the disclosure of which patent likewise is incorporated herein by reference.

TECHNICAL FIELD

The present invention relates in part to devices, including packaging and coverings used to produce or maintain desired temperature levels substantially different from the ambient for an extended period of time, and more particularly to a computerized follow-up and tracking system using such devices, as well as others, including particularly temperature and time extent monitoring, in the delivering and temperature protection of perishable goods, such as, for example, temperature sensitive groceries, seafood, medicines, confections, temperature sensitive gifts, plants, flowers or floral arrangements, and the like. The exemplary product and methods solution of the present invention are described below in detail as they apply in the food or grocery delivery industry. However, the present invention also has application in such additional industries as the "safe delivery"$^{SM}$ of seafood, pharmaceuticals, medical shipments (e.g., test specimens in the clinical laboratory segment), confectionery, gift packages, flowers or floral arrangements, etc.

BACKGROUND ART

As a general proposition, it is known in the transportation industry to attempt to achieve some degree of desired temperature control for products being shipped using, for example, gel packs, "dry ice" (frozen carbon dioxide) and the like. As a substantial advance over the foregoing prior art devices, vastly improved, cooling or heating devices using sheets of packet material which include porous cells containing a super-absorbent polymer have much more recently been suggested, which are described in some detail in the above referenced patent and patent applications. Further reference is had to U.S. Pat. No. 5,628,845 issued May 13, 1997 entitled "Process for Forming Hydratable, Flexible Refrigement Media" by Murray and Browne, and to PCT/US 92/06486 (published as WO 93/02861 on Feb. 18, 1993) of George Barrett (now deceased), a predecessor to the work that preceded the present invention.

For general background, informational, purposes, reference is also had to the article entitled "Pharmaceutical shipments chill out from within" from the January 1998 edition of Packaging World (a Summit publication, One IBM Plaza, Suite 3131, 330 N. Wabash Ave., Chicago, Ill. 60611; note p. 38), which article discusses some of the beneficial effects of early test work which preceded the present invention.

For example, as disclosed in one or more of these patents and/or publication ,the sheets of packet material are initially submerged in water, hydrating them, and the hydrated sheets are then frozen (for cooling effects) or heated (for heating effects) and placed in at least proximity to and more typically in juxtaposition to the goods to be cooled/heated. As the packet sheet(s) begin, for example, to warm up or thaw, the absorbed "water" goes directly from the frozen state into a gaseous state, avoiding wetness problems. The cells are formed in packets, producing longitudinally and laterally extended separation lines, which allow the completed packet sheets to be folded about either or both axes and thus contoured around the goods being cooled (or heated), surrounding them.

With respect to temperature and elapsed time monitoring in connection with the product "VitSab," see the information provided by Cox Technologies on the product at their web site (www.cx-en.com/cox.htm) and a related web site (www.vitsab.com/) which include the following articles:

"Integrating Time and Temperature for Seafood Quality and Safety" by Dr. Steve Otwell, recently published in Seafood International; and "Evaluation of Time Temperature Indicator Tags Used to Track Cut Lettuce Quality in the Cold Chain" by Dr. Paul Singh, U.C. Davis, Davis, California (available at www.vitsab.com/VITsaladstudy.htm);

which in turn cite:

Barriga, M. I., G. Trachy, C. Willemot, and R. E. Simard, 1991. "Microbial Changes in Shredded Iceberg Lettuce Stored Under Controlled Atmospheres," *Journal of Food Science,* 56:1586–1588;

Barton, L., L. James-Davies, and D. Clingman, 1996. "Application of time-temperature monitoring devices during the refrigerated distribution of fresh fish," Departmental Publication No. 2 Visual Indicator Tab Systems, AB, Malmö, Sweden [available at www.vitsab.com/barton.htm];

Bengtsson, N. and K. G. Blixt, 1996. "The Role of Simple Monitoring Devices in the Distribution of Perishable Food Products" Appendix B to USDA Pub. *The Role of Simple Monitoring Devices in the Distribution of Perishable Food Products;*

Brackett, R. E., 1994. "Microbiological Spoilage and Pathogens in Minimally Processed Refrigerated Fruits and Vegetables," Chapman and Hall, New York, pp.269–312;

Cox, J. L., 1997. "Technical Introduction to the Vitsab® TTI System," COX Recorders Technical Bulletin 17:1–8. (Available from Cox Recorders, 69 McAdenville Road, Belmont, N.C. 28012—1-800-848-9865);

Fu, B. and Labuza, T. P. 1992. "Considerations for the application of time-temperature integrators in food distribution," J. Food Distr. Res., 23(1):9–17;

Labuza, T. P, and Fu, B. 1992. ""Microbial Growth Kinetics for Shelf Life Prediction: Theory and Practice," in *Proceedings of the International Conference on the Application of Predictive Microbiology and Computer Modeling Techniques to the Food Industry,* R. L. Buchanan and S. Palumbo, eds., Apr. 12–15, 1992, Tampa, Fla.;

Nyguyen-the, C. and F. Carlin, 1994. "The Microbiology of Minimally Processed Fruits and Vegetables," *Critical Reviews in Food Science and Nutrition,* 34:371–401;

Nyguyen-the, C. and J. P. Prunnier, 1989. "Involvement of Pseumonads in Deterioration of 'Ready to Use' Salads," *Journal of Food Science and Technology,* 24:47–58;

Otwell, S., 1997. "Integrating Time and Temperature for Seafood Quality and Safety," *Seafood International* (in press) [also available at www.vitsab.com/ salmon.htm]; and Singh, R. P. 1994. "Scientific Principles of Shelf Life Evaluation.," *Shelf Life Evaluation of Foods.* Ed. Man, C. M. D. and Jones, A. A. Blackie Academic & Professional Press.

In providing the foregoing citations there is no acknowledgment that all of them are part of the prior art pertinent to the field of the present invention.

In a separate art, it is desired to have, for example, groceries delivered from a purveyor to a consumer, a practice which was somewhat commonplace in the first half of the $20^{th}$ Century but generally since then has become relatively rare in comparison to the direct purchase of groceries at the supermarket. However, with the blossoming of the Internet and e-commerce on the Internet, great interest is again being directed to the delivery of groceries in connection with an order placed over the Internet, as well as by telephone.

However, with respect to the e-commerce approach on the Internet, the problem with Internet grocery deliveries is that the seller cannot leave perishable goods, such as, for example, milk, ice cream, etc., unprotected, since typically the seller does not know when the customer will arrive to put the temperature sensitive goods into the refrigerator and/or freezer. Therefore, most Internet grocery purveyors require the customer to be at home to receive the delivered order. The alternative, followed by a few purveyors, is to sell only non-perishable goods via the Internet. Both alternatives have problems.

Requiring the customer to be at home for delivery shrinks the convenience food market that the purveyor should otherwise reasonably expect to win as customers. Having the customer specify, for example, a 30-minute window for delivery requires the customer and purveyor to operate under a logistical deadline that is cumbersome. This causes the customer to question whether Internet grocery shopping is "really" better than going to the comer store or local supermarket. Purveyors choosing this alternative generally deliver groceries from a refrigerated van or deliver them in a hard wall cooler. Both approaches represent a significant capital expense. The latter also requires on-going expense caused by cleaning, damage and lost coolers.

Refusing to sell perishable goods over the Internet because of diminution of quality and/or possible bacterial contamination due to temperature attack limits the customer potential even more. Purveyors choosing this alternative can only deliver dry goods from a normal van.

Purveyors choose these alternatives partly because of liability concerns from a food being spoiled by temperature and a customer becoming ill. Another reason is to avoid the problem of complaining customers going to the media in the event that perishables spoil, even if caused by the customer delaying a return home for several hours after the groceries have been delivered.

Some examples of Internet e-commerce grocery delivery sites are:

www.homegrocer.com;

www.albertsons.com;

www.peapod.com; and www.webvan.com.

Although several industry purveyors have tried to locate a method of delivering perishables to an empty home with an ability to guarantee efficient temperature performance for three to six hours, they have been unable to do so, in spite of the relatively long felt need to have such a delivery system.

The present invention provides a utilitarian, innovative solution to this problem.

GENERAL DISCUSSION OF INVENTION

As noted above, the present invention relates in part to devices, including packaging and coverings used to produce or maintain desired temperature levels substantially different from the ambient for an extended period of time, and more particularly to a computerized follow up and tracking system using such devices, as well as others, including particularly temperature and time extent monitoring, in the delivering and temperature protection of perishable goods, such as, for example, groceries, seafood, medicines, confections, temperature sensitive gifts, plants, flowers or floral arrangements, and the like. The exemplary product and methods solutions of the present invention are described below in detail as they apply in the food or grocery delivery industry to protect the delivery of perishable food items. However, the present invention also has application in such additional industries as the safe delivery of seafood, pharmaceuticals, medical shipments (e. g., test specimens in the clinical laboratory segment), confectionery, gift packages, flowers or floral arrangements, etc.

The preferred embodiment of the present invention provides a "safe delivery"$^{SM}$ system which keeps the cost as low as possible for the purveyor, allowing the purveyor to use some components, e.g., corrugated boxes that likely are already in the purveyor's inventory. Several other elements are involved to solve the total problem. Some are tangible products and some are tangible instruments used in combination with business methods; both used to plan and verify successful shipments.

All of the preferred system elements are numerically listed below:

1. An appropriate container for the perishable groceries, preferably rigid or at least generally self-supporting in its structure, and preferably a relatively inexpensive, corrugated cardboard box (e.g., with a single flute) or corrugated material, used to contain the perishable groceries. In its broadest scope, the present invention is not limited to a particular container or a particular cardboard box, although there are certain preferable approaches discussed more fully below.
2. A source of cold (or heat as may be needed), serving as a temperature generator appropriately affecting the temperature inside the container to maintain the temperature inside the box within a desired or acceptable temperature range for a number of hours. Such source preferably is a sheet of packet material containing a super-absorbent polymer which is hydrated and can then be either frozen (e.g., in a freezer) or heated (e.g. in a microwave), as needed, which hydrated packet material affects the temperature of the environment in which it is used for an appropriately long period of time (at least several hours and preferably longer) without producing moisture as it, in the case of a cooling or source, warms up or thaws, or, in the case of a heat or heating source, as it cools down, because the contained "water" goes directly from the solid phase to the gaseous phase, i.e., sublimes into a vaporous form.

3. For cold applications, a protective heat insulating cover, preferably for the entire box (or other container), to protect the box and its contents from external heat from radiation (e.g., sunlight). The balance of the packaging structure inside the heat insulating cover [e.g., the corrugated walls of the box, the hydrated packet material, and the bubble wrap (see below)] present barriers to heat attack from convection (e.g., hot air movement) and/or conduction (e.g., heat transferred from other objects in contact with the package structure). The protective cover preferably comprises or includes a metallized film, as well as preferably a secure closure to avoid or at least substantially deter heat leaks (convection) and to provide some water proofing or retarding capabilities for rain protection, with or without the use of bubble wrap.
4. A time/temperature alert product (which can be, for example, an enzyme-based product) which is activated when the perishable groceries are packed by the purveyor. The alert signals "safe" at least if the temperature does not exceed a preset or predetermined temperature, and preferably also if the time since activation does not exceeds a preset or predetermined time. If either the elapsed time or temperature is exceeded, the alert signals an "alarm," and the customer knows that either the elapsed time and/or the temperature has been exceeded and the perishable items are not warranted by the purveyor to be safe. In the preferred method aspects of the invention, if the alert signals an "alarm," the customer is responsible for contacting the purveyor to, for example, arrange for a pickup of the now unwarranted goods to be returned to the purveyor. The latter may be done at either no charge to the customer or at some charge if the customer went beyond the agreed to time range of delivery before opening the packaging of the goods to put at least the perishable goods away in the refrigerator/freezer, as appropriate.
5. An innovative "business method" or physical methodology (preferably computerized) to insure that the purveyor knows at least approximately when the customer has opened the box of groceries, while preferably also providing other useful information. This can be accomplished by a automated tracking system which involves in its preferred embodiment the use of a unique transaction identifying alphanumeric code, which the customer is obligated to transmit to the purveyor, preferably through an automated telephonic or telecommunications system.

In the preferred embodiment this involves, for example, a card packed in or placed on the top of the preferred covered, corrugated box. The card preferably is prepared at the same time as the bill of lading or other like record for the shipment. The card preferably has a unique number (purely numeric or in alphanumeric form) assigned to the shipment, which preferably is printed or otherwise provided on the card.

To complete the delivery transaction, the customer preferably is required to call a telephone number provided by the purveyor or otherwise telecommunicate with the purveyor via, for example, a computer connected to the purveyor's web site on the Internet, which in turn is tied into the purveyor's computerized data base. Thus, the telephone number or other telecommunication preferably automatically interfaces or connects to the purveyor-controlled computerized database. The customer preferably punches or keys in the unique number from the card, which in sending the alphanumeric information also automatically informs the purveyor of the date, and inferentially the time that the customer opened and unpacked the groceries.

It should be noted that, in using the term "telecommunicate" herein, such is generally intended to broadly cover computer-to-computer communication, including not only hard-wired telephonic or telecommunication lines but also wireless or satellite communication links.

If the customer does not "call" in, the purveyor's computer preferably will call the customer's telephone number, for example, repeating every ten (10) minutes until successfully answered and responded to, for a pre-set time period of time (e.g. one hour or, alternatively, for as long as the allowed time period between packing and opening the package has not elapsed), with a recorded message that provides data entry instructions. This serves to remind the customer to, for example, punch in the unique number on the telephone keypad when prompted by the purveyor's computerized messaging and data receiving system and, if the call is not at the time of opening the delivered package, when the package was opened and the perishable food appropriately refrigerated.

This entire method protects the purveyor since the purveyor will know at least the approximate time that the customer opened the delivered groceries and determine whether the perishable goods are within the warranty period. If no unique identification number is ever entered into the purveyor's computer or computer system, the purveyor will have sufficient reason to, for example, void warranty on that grocery delivery, since the customer did not uphold his/her end of the implied or written contract or oral agreement. The terms of this kind of grocery delivery contract or arrangement preferably is explained to the customer at time of order entry and fortified over time by customer action on subsequent deliveries until it becomes an ingrained customer habit and preferably is covered at the time the customer originally subscribes to the service, at which time a written agreement preferably is entered into containing appropriate provisions detailing the arrangements and warranty with respect to the delivery of perishable goods.

Additionally, a "calculator," preferably computerized and preferably tied into the purveyor's computerized order receiving system, is used which, based on extensive and continuing test experience, is capable of predicting the recommended nature and volume of, for example, the cooing/heating source and the other packing materials that should be used to insure a successful shipment of particular perishable foods. Some variables involved preferably include inter alia the time of year or ambient weather condition, destination location, transport method, projected transit time, perishable product(s) being delivered, etc.

The "calculator," using standard and special algorithms, is applicable to slide rule, electronic calculator and computer software, with the latter being much preferred. For example, in the purveyor's entering the ordered groceries, which order includes one or more perishable items, the computerized system using automated evaluation algorithms and any needed supplemental data input from the data processor operator, preferably automatically calculates and informs the purveyor's shipping department what package configuration (items 1–3 above) should be used for the order involved. Updating data tracking of the number of "successful" vs. "unsuccessful" deliveries of the perishable goods and the details of the shipments involved likewise preferably are used to intelligently update the calculator algorithms.

In the foregoing, the primary application has been keeping perishables item(s) cold with the various elements or components described, with the perishables involved being in many forms (primarily foods, but also applicable to pharmaceuticals, medicines, organ transplants, confections, floral related products, etc.), with grocery delivery as the primary example. However, it should be understood that the principles of the invention are also applicable to the extreme problem of delivering groceries (or other perishable goods) in overly cold environments, such as, for example, in Duluth, Minn. in February. In such a situation, the perishable groceries (milk, eggs, cheese, lunchmeat, etc., which typically are only refrigerated) need to be protected from becoming too cold and, for example, from freezing into a solid mass.

This is a tougher challenge, as the cool groceries must be kept at acceptable refrigerator temperatures [e.g., from about 30–33 degrees F. (comparable to a cold refrigerator) up to about 40–45 degrees F. (comparable to a warm refrigerator) while also using a temperature affecting, warming device in ambient conditions that can get as low as, for example, −30 degrees F. wind chill. Thus, the packaging of the fragile or perishable groceries being delivered must keep them from getting much above about 45 degrees F., while also maintaining them above about 30–33 degrees F. or possibly lower, depending on the particular, usually refrigerated, perishable involved. For example, milk can be allowed to go down to a temperature much lower than 30–33 degrees F., without harm, for example, down to about 23 degrees F., with the actual allowed lower temperature being dependent on, for example, the amount of butter content. Even with the allowably low temperature of 23 degrees F., there is still a potential temperature difference of approximately 53 degrees F. with the extremely low temperature of the ambient.

In such an extremely low ambient temperature situation, for example, well below zero degrees F., a supplemental material, for example and preferably, bubble wrap, preferably is used to line the interior wall surfaces of the a corrugated box container, with the bubble wrap being applied to at least the bottom and preferably on all of its interior wall surfaces, including its four side walls and its bottom and top. The bubble wrap helps keep heat inside the box, this time by delaying thermal transfer to the outside via conductive heat.

Additionally, preferably inside the box interior bubble wrap is a layer of heated, hydrated packet material, which has been hydrated and heated in, for example, a microwave oven. The packet material is heated to, for example, over 100 degrees F. just before it is to be used. Inside the layer of heated, hydrated packet material preferably is a second layer of bubble wrap that slows the heat from being conducted from the heated packet material into the perishable foods, which are located in the innermost chamber or area. Both layers of bubble wrap preferably are configured with the bubble side toward the hydrated packet material to increase the volume of trapped air that acts as a thermal barrier at those facing surfaces.

Thus, in this extremely low ambient temperature situation, the perishable food items are initially packed in frozen packet material in, for example, the same fashion as they would in a warm ambient temperature environment. Then a first, all encompassing, surrounding layer of bubble wrap is provided around the cold temperature protected perishable goods, with its bubble side out, then an all encompassing layer of heated (or, as noted below, an unheated but hydrated) packet material is placed around the bubble wrapped, cold protected goods, then another, all encompassing layer of bubble wrap is provided via the interior, layered walls of the box container with its bubble side in, and then comes, or course the walls of the box container itself and the outer protective cover.

Thus, once the box is packed and sealed, preferably an, outer, protective, black, heavy gage, plastic film cover is used to cover the entire box container. The gage of the film can be similar to the protective, metallized cover described above, but without the need for the metallized layer, and the preferred material for the plastic is polyethylene. Like the metallized film cover used for pure cooling applications, the black cover for the heating applcation preferably is constructed with a lip having a two-sided, tape sealing mechanism.

Although for very extreme, low ambient temperature conditions the heating of the intermediate layer of packet material may be desirable, in some conditions, merely hydrating the packet material is sufficient without any heating, with the unheated and initially unfrozen packet material serving as a "cold sink," absorbing the extreme cold from the ambient until it itself becomes frozen, thereby greatly assisting in the prevention of the extremely cold ambient reaching the usually refrigerated perishable in the innermost chamber of the packaged box.

The foregoing techniques for combating extremely low ambient temperatures are primarily directed to normally refrigerated, perishable goods. Frozen foods, such as, for example, ice cream, on the other hand, effectively have no limit to the temperature it may go down to, and, therefore, is typically not of concern in such extremely low, ambient temperatures.

Like the pure cooling applications, the heating application is subject to many variations in configurations and combinations.

BRIEF DESCRIPTION OF DRAWINGS

For a further understanding of the nature and objects of the present invention, reference also should be had to the following detailed description, taken in conjunction with the accompanying drawings, in which like elements are given the same or analogous reference numbers, and wherein:

FIG. 12 is a side, cross-sectional view of a section of the packet sheet embodiment of FIG. 11; while

FIG. 14 is a perspective view showing a part of the packet sheet roll of FIG. 13 used to wrap an exemplary fish as a further, exemplary perishable grocery or seafood item, as an example application of the packet sheet material used as an element in the preferred embodiment of the present invention; while

EXEMPLARY MODES FOR CARRYING OUT THE INVENTION

Preferred Protective Packing Approaches (FIGS. 2–9)

Figure 2:
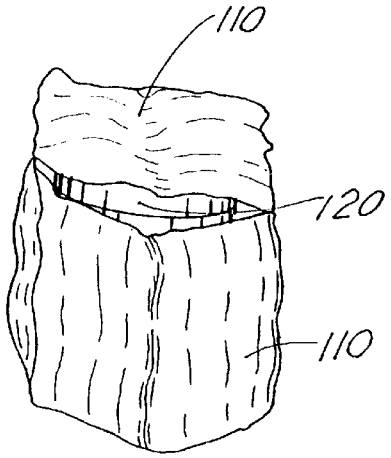
FIG. 2 is a side, perspective view of a frozen perishable grocery item (e.g., ice cream), inserted in a pouch-equivalent wrapping with a top cover of packet sheet material providing a surrounding source of coldness to the grocery item, as used in the preferred embodiment of the system of the present invention.
Figure 3:
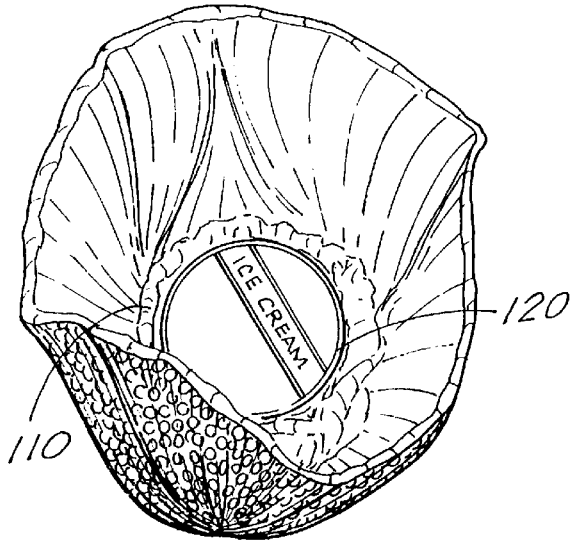
FIG. 3 is a top, perspective view of the frozen perishable grocery item (e.g., ice cream), inserted in the pouch-equivalent wrapping with top cover of packet sheet material providing a surrounding, encompassing source of coldness to the grocery item, as in FIG. 2, but now inserted into a further, individualized pouch of three ply material, including an inner foam ply and an outer bubble wrap ply with an intermediate metallized film ply, with the cover top of packet material shown in FIG. 2 being temporarily removed (shown in phantom line) to show the ice cream content, as used in the preferred embodiment of the system of the present invention.

The preferred, exemplary embodiment of the present invention provides a "safe delivery"$^{SM}$ system for perishable goods, particularly groceries, which keeps the cost as low as possible for the purveyor, allowing the purveyor to use some components, e.g., corrugated boxes that likely are already in inventory. Several other elements are involved to solve the total problem. Some are tangible products and some are tangible instruments used in combination with business methods; both used to plan and verify successful shipments. All of the system elements are listed below, with reference primarily to FIGS. 2–9:

1. An appropriate container 100 (note FIGS. 4, 6, 7 & 8) for the perishable groceries, preferably rigid or at least self-supporting in its structure, and preferably a relatively inexpensive version of a corrugated cardboard box. 100 (e.g., one with a single flute) or corrugated material, used to contain the perishable groceries 120/120'. Variations of corrugated boxes, such as, for further example, ones with double flutes, may be used, if desirable for certain applications.
2. At least one source 110 or 110*a* of cold (or heat as may be needed) appropriately affecting the temperature inside the container 100 to maintain the temperature inside the box within the desired or acceptable temperature range. An individual, specific perishable item source 110 could be used as illustrated in FIGS. 2 & 3, or, alternatively, an all-encompassing source 110*a* could be used as a substitute or a supplement (see FIGS. 5 & 6). The preferred cold/heat source 110/110*a* is made up of "ThermaFreeze"® sheet packet material 110 (10, see FIGS. 11–13) using a hydrated, super-absorbent polymer (14, note FIG. 12), which is hydrated (14', note FIG. 12A) and then can be either frozen (e.g., in a freezer) or heated (e.g., in a microwave oven), as needed, which hydrated packet material affects the temperature of the environment (e.g., enclosed perishable groceries 120/120') and maintains it for an appropriate period of time (e.g., 4–6 hours or longer), without producing moisture as the packet material warms up or thaws (in a cooling application) or cools down (in a heating application) because the contined "water" sublimes.

Tests prove that the total time required for the "thawed" but still partially hydrated packets 17 to become entirely flat (containing no "water"; note FIG. 12) is six to eight (6–8) days. In the initial period, after the packets 17 are thawed, there is also an evaporative cooling effect due to the ultra-slow release of "water" vapor that tends to slow temperature rise. In addition, in either the frozen or the thawed state, the packet material tends to act as an additional thermal barrier, slowing thermal intrusion from conducted heat.

For refrigerant or cooling situations, some purveyors of perishable groceries may use as a supplement to or substitute for the sheets of packet material, for example, less efficient, gel packs or dry ice, by individual preference or other requirement, although, as noted, the hydratable packet material 110/10 containing a super-absorbent polymer 14/14' is much preferred.

3. For cooling applications (cold source 110/110*a*), preferably an outer, radiant energy protective cover 130 for the entire box 100 is used. The preferred cover 130 is a one, two or three (1, 2 or 3)-ply "ThermaBarrier"® cover for the entire box 110 to protect the box and its contents (including one or more items of perishable groceries 120/120') from heat from radiation (e.g., sunlight). The balance of the structure or packing inside the heat insulating cover (corrugated box 100, hydrated packet material 110/110*a*, bubble wrap material 140) presents a series of barriers to heat attack from convection (e.g., hot air movement) and/or conduction (e.g., heat transferred from other objects in contact with the package structure). The cover 130 also protects the preferred corrugated cardboard box against rain (or snow or slush in a heating situation).

The cover 130 preferably includes a metallized film, with an emmissivity rate of about 94 or better. The basic metallized film raw material is typically referred to as a "radiant barrier." The preferred embodiment is a metallized film produced by vacuum depositing a thin, outer layer 131 of aluminum, or other high emmissivity metal, on a heavy-gage plastic film. The preferred plastic film is polyethylene, although other molecular structures may be used.

The cover 130 may also be made up of two or more layers or plies of material, preferably with the outer metallized surface layer 131, as described, and preferably a bubble wrap layer using, for example, 3/16th bubble wrap as a lower-most or bottom layer. A three-ply material that uses, for example, a foam layer similar or identical to the Tenneco product "Microfoam"® could be used, with the foam as an interior or middle layer, between the metallized layer 131 and the bottom bubble wrap layer. Such an exemplary foam comprises a stable, plastic foam made from polypropylene and polyethylene films with anti-static and coloring additives. Regardless of the number of plies and the outer layer material used, the cover 130 preferably is water proof or retardant to protect the preferred corrugated cardboard box container 100 from rain, etc.

An appropriate protective, outer cover preferably is also used where a heat source is included to, for example, combat extremely low, i.e., well below freezing temperatures.

The protective, outer cover 130 preferably also includes a secure closure 133 to avoid heat leaks (convection) and to further ensure the water-proof or retardant characteristics discussed above. The preferred closure 133 is a double sided, adhesive tape (such as that used in laying carpet), since it provides a highly secure closure. Such tape also allows reusability on the same cover for, for example, at least ten times. Other exemplary closures include "Velcro"® or other "hook & loop" type materials and/or other types of double-sided tape or other forms of closures.

Figure 14:
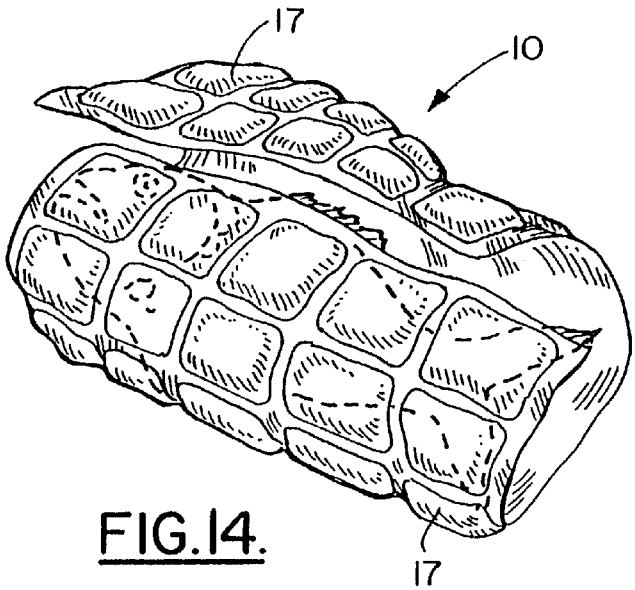
Figure 15:
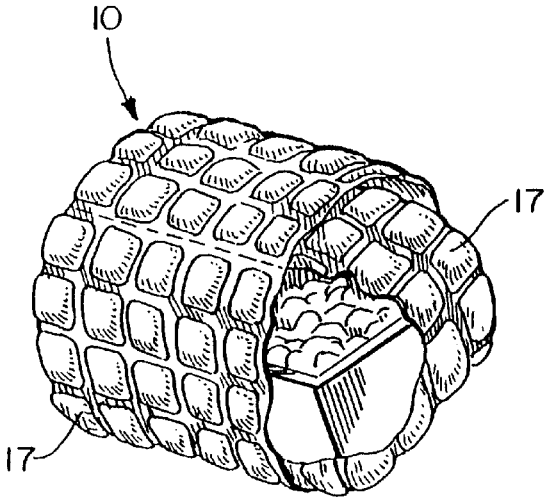
FIG. 15 is a perspective view showing apart of the packet sheet material roll of FIG. 13 used to wrap an exemplary box of temperature-sensitive material as a further example application of the packet sheet material used as an element in the preferred embodiment of the present invention.

Internal pouches and sleeves and wrappings or other forms of enclosing elements (note, for example, pouch-equivalent wrappings 110) are used for individualized, "super protection" of highly temperature sensitive products, such as the illustrated ice cream 120 of FIG. 2, fresh chicken and fresh fish (note FIG. 14), etc. FIG. 15 likewise shows a part of the packet sheet material roll of FIG. 13 used to wrap an exemplary box of temperature-sensitive material as still a further example application of the packet sheet material 10 used as an element in the preferred embodiment of the present invention.

Figure 5:
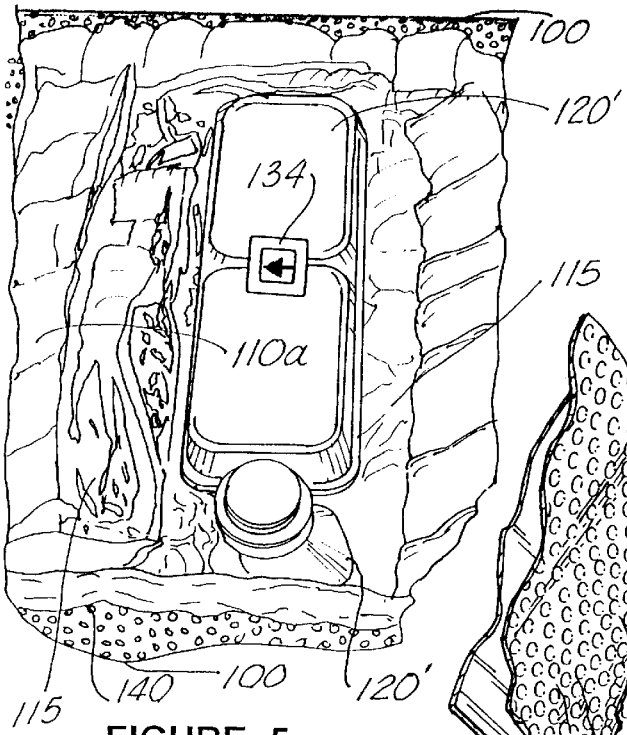
FIG. 5 is a top, perspective view showing other types of perishable grocery items (e. g., eggs & milk) that, when stored, are cooled or refrigerated but not frozen, inserted in an all-encompassing pouch of hydrated, frozen, packet sheet material providing a source of coldness to all of the enclosed grocery items, including the perishable grocery items of eggs & milk), with the pouched groceries inserted into the bubble wrapped interior of the box of FIG. 4, as used in the preferred embodiment of the system of the present invention.

These internal protective "pouches" or enclosing, encompassing wrappings are also applicable to other types of products, such as, for further example, pharmaceutical preparations, clinical laboratory specimens, etc. Such pouch and sleeve products may be a single-ply metallized film (acting as a cold environment containment) and/or a two-ply product comprising a ply of metallized film and an outer ply of bubble wrap, using the preferred $3/16^{th}$ bubble rap applied with the bubbles, rather than the flat side, against the metallized surface of the film. A third configuration would include, for example, an inner foam ply using a foam similar to Tenneco's "Microfoam"® product. The selection of specific ply structure is a function of the degree of protection required across the time period desired. Exemplary pouches with a metallized outer surface are shown in FIG. 5.

"ThermaBarrier"® 1-Ply is a metallized film that repels radiant energy from sunlight from the surface of the material; while "ThermaBarrier"® 2-Ply is the metallized film that includes an outer covering of bubble wrap (preferably $3/16^{th}$) that is laminated to the first ply with the bubbles (not the flat side of the bubble wrap) against the metallized film. This configuration doubles or otherwise increases the thermal protection of the bubble wrap since it doubles or otherwise increases the volume of air trapped between the plies.

"ThermaBarrier"® 3-ply material includes a layer (e.g., a $1/8^{th}$ or 1/4" in thickness) of foam (similar to "Microfoam"® produced by Tenneco Packaging) with one metallized side. Bubble wrap forms the third ply and is laminated to the outside (i.e., metallized) surface. The material is preferably used in the form of a pouch, wrapping with a cover or a liner with this 3-ply configuration.

For example, a three (3)-ply "ThermaBarrier"® pouch preferably is used inside the preferred corrugated box 100 to contain especially temperature sensitive food products, such as, for example, ice cream 120, etc. The pouch materials consist of foam (similar to the Tenneco product named "Microfoam"®) that can be $1/8^{th}$ or 1/4 inch thick or some other effective thickness. The foam layer can be used either by itself or with one side metallized for radiant energy protection. In the preferred example, the metallized version is used. The third ply is common bubble wrap. This same configuration can be assembled by forming the metallized film into an outer "shell" designed to have a foam insert (similar to the Tenneco product named "Microfoam"®), produced without a metal layer. The shell may or may not have a $3/16^{th}$ bubble wrap laminated to the outer surface. However, whenever bubble wrap is used, it preferably is applied to the outside layer of the pouch with the bubbles, not the flat side of the bubble wrap, against the outer (i.e., metallized) side of the foam. That configuration doubles or otherwise increases the barrier protection against conductive heat by trapping, for example, twice the amount or some other increased amount of air than is trapped if the bubble wrap were applied with the flat side against the outer layer of the foam ply.

4. A time/temperature alert product 134 (note FIG. 5), which can be, for example, similar to that of or identical to a Swedish product named "VitSab"®. This enzyme-based product using enzymatic color indicators is activated by the purveyor's packer when the groceries are packed and it is either placed in with the packed perishable goods or attached to the outer surface of the covered container 130/100, depending on what factors are being monitored and how many monitors are being used. If the preferred, single monitor is being used to show whether either the maximum set temperature has been exceeded or the maximum allowed time elapsed has been exceeded, the monitor is placed in the interior of the packaging with the perishable goods. On the other hand, if only the maximum elapsed time is being monitored or is being separately monitored, the monitor 134*a* (note FIG. 9) can be placed on the exterior of the covered box 130/100.

The preferred "VitSab"® monitor 134 comes in the form of a substantially flat member with an adhesive back and two, juxtaposed, sealed, rectangular sections with a centrally located, sealed, circular "button" over-lapping the two rectangular sections on its front. The "button," when sufficiently pressed, breaks the seals and causes an enzyme mixture to be created, activating the monitor and the two rectangular sections, one effectively monitoring the elapsed time from actuation up to a maximum time period and the other the temperature reached up to a maximum. If the pre-designed, maximum elapsed time is exceeded, its rectangular section, normally green in color, turns to the color yellow; while if the pre-designed maximum temperature is exceeded, its rectangular section, normally green, likewise turns to the color yellow. Thus, if either rectangular section has changed to yellow by the time the customer opens the packaged goods, the warranty is effectively terminated under the currently preferred methodology.

Thus, the alert signals "safe" if the temperature does not exceed the preset or predetermined temperature and if the time since activation does not exceeds the preset or predetermined time. If the elapsed time or set temperature is exceeded, the alert effectively signals an "alarm," and the customer knows that either the elapsed time and/or the temperature has been exceeded, and the perishable groceries are no longer warranted. If the alert signals an "alarm," the customer preferably is responsible for contacting the purveyor for a return of the goods in the preferred methodology of the invention.

Figure 9:
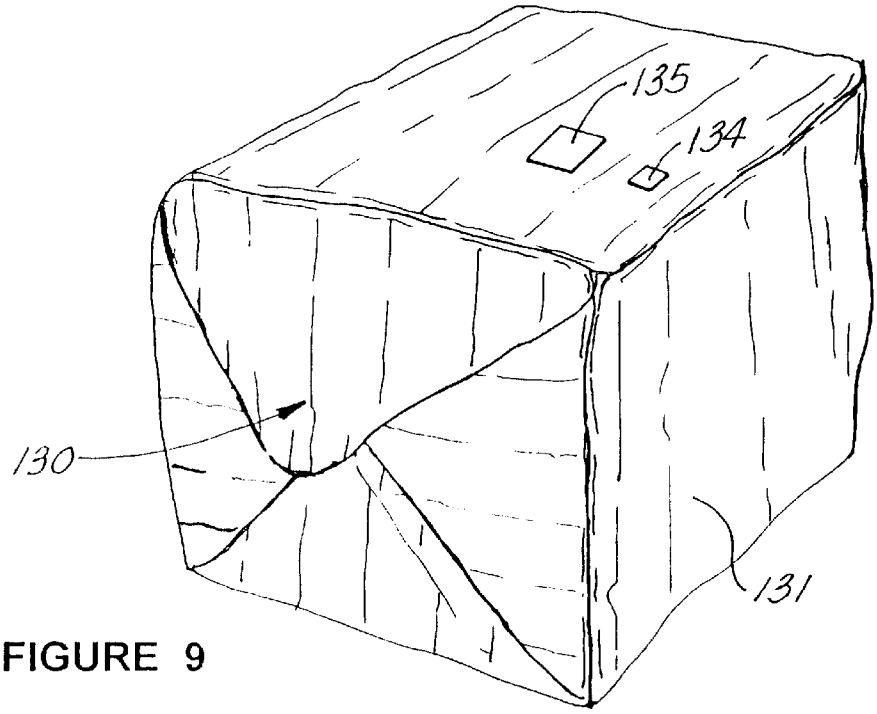
FIG. 9 is atop, perspective view of the elements of FIG. 8, but with the outer pouch top fully pulled over the top of the box and with the pouch top secured over the box, with the box having its transaction identification card and temperature and monitoring element both affixed to the top of the box, with the packaged groceries now ready to be protectively delivered, as used in the preferred embodiment of the system of the present invention.

As an alternative, if it is desired to only monitor the maximum allowed elapsed time from packing to opening, a single monitor 134*a* is used and preferably is attached to the outside of the covered, sealed box 130/100 as illustrated in FIG. 9.

Whichever is the case, the monitor 134/134*a* typically will be applied to or otherwise used on a backing card, which preferably includes printed instructions for the customer with respect to calling the purveyor when the package is opened and what the displayed color(s) on the monitor mean. In the latter instance, that is, with respect to using the time elapsed monitor 134*a* on the exterior of the covered box, the unique alphanumeric code or transaction identifying code (see below) could be applied to the informational part of the monitor backing card, and, in essence, the cards 134*a* and 135 combined into one.

5. An innovative "business method" or tangible methodology (preferably computerized) to insure that the purveyor knows at least approximately when the customer has opened the covered box 130/100 of groceries. This involves, for example, a card 135 (note FIG. 9) packed in or placed on the top of the preferred, covered, corrugated box. The card 135 preferably is prepared at the same time as the bill of lading or other like record for the shipment. The card 135 preferably has a unique number (purely numeric or in alphanumeric form) assigned to the shipment, which preferably is printed on the card.

To complete the delivery transaction, the customer preferably is required to call a telephone number provided by the purveyor or otherwise telecommunicate with the purveyor via, for example, a computer connected to the purveyor's web site on the Internet. The telephone number or other telecommunication preferably connects to a purveyor-controlled computerized database. The customer preferably punches or keys in the unique number from the card 135, which in sending the alphanumeric information also automatically informs the purveyor of the date; and inferentially the time that the customer opened and unpacked the groceries. It should be noted that, in using the term "telecommunicate cate" herein, such is generally intended to broadly cover computer-to-computer communication, including not only hard-wired telephonic or telecommunication but also wireless or satellite communication links.

If the customer does not "call" in within a set elapsed time, the purveyor's computer system preferably will call the customer's telephone number, for example, every ten (10) minutes preferably for a preset period of time, for example, an hour, with a recorded message. This serves to remind the customer to, for example, punch in the unique number on the telephone keypad when prompted by the purveyor's computerized messaging and data receiving system.

This entire method protects the purveyor since the purveyor will know at least the approximate time that the customer opened the delivered groceries. If no unique identification number is ever entered into the purveyor's computer or computer system, the purveyor will have sufficient reason to, for example, void warranty on that grocery delivery, since the customer did not uphold his/her end of the implied or written contract or oral agreement. The terms of this kind of grocery delivery contract or arrangement preferably is explained to the customer at time of order entry and fortified over time by customer action on subsequent deliveries until it becomes an ingrained customer habit and preferably is covered in allowing the customer to originally subscribe to the service, at which time a written agreement preferably is entered into containing appropriate provisions detailing the arrangements and warranty with respect to the perishable goods.

Additionally, a "calculator," preferably computerized, is used which based on extensive and continuing test experience, is capable of predicting the recommended nature and volume of, for example, "ThermaFreeze"® refrigerant and of the other protective materials required to insure a successful shipment. Some variables involved preferably include inter alia the time of year and/or ambient weather condition, destination location, transport method, projected transit time, product being delivered, etc. The calculator, using standard and special algorithms, will be applicable to slide rule, electronic calculator and computer software, with the latter being preferred. For example, in the purveyor's entering the ordered groceries, which order includes one or more perishable items, the computerized system using automated evaluation algorithms and any needed supplemental data input from the data processor operator, would automatically calculate and inform the purveyor's shipping department what package configuration (items 1–3 above) should be used for the order involved. Updating data tracking of the number of "successful" vs. "unsuccessful" deliveries of the perishable goods and the details of the shipments involved likewise preferably are used to intelligently update the calculator algorithms.

Figure 10:
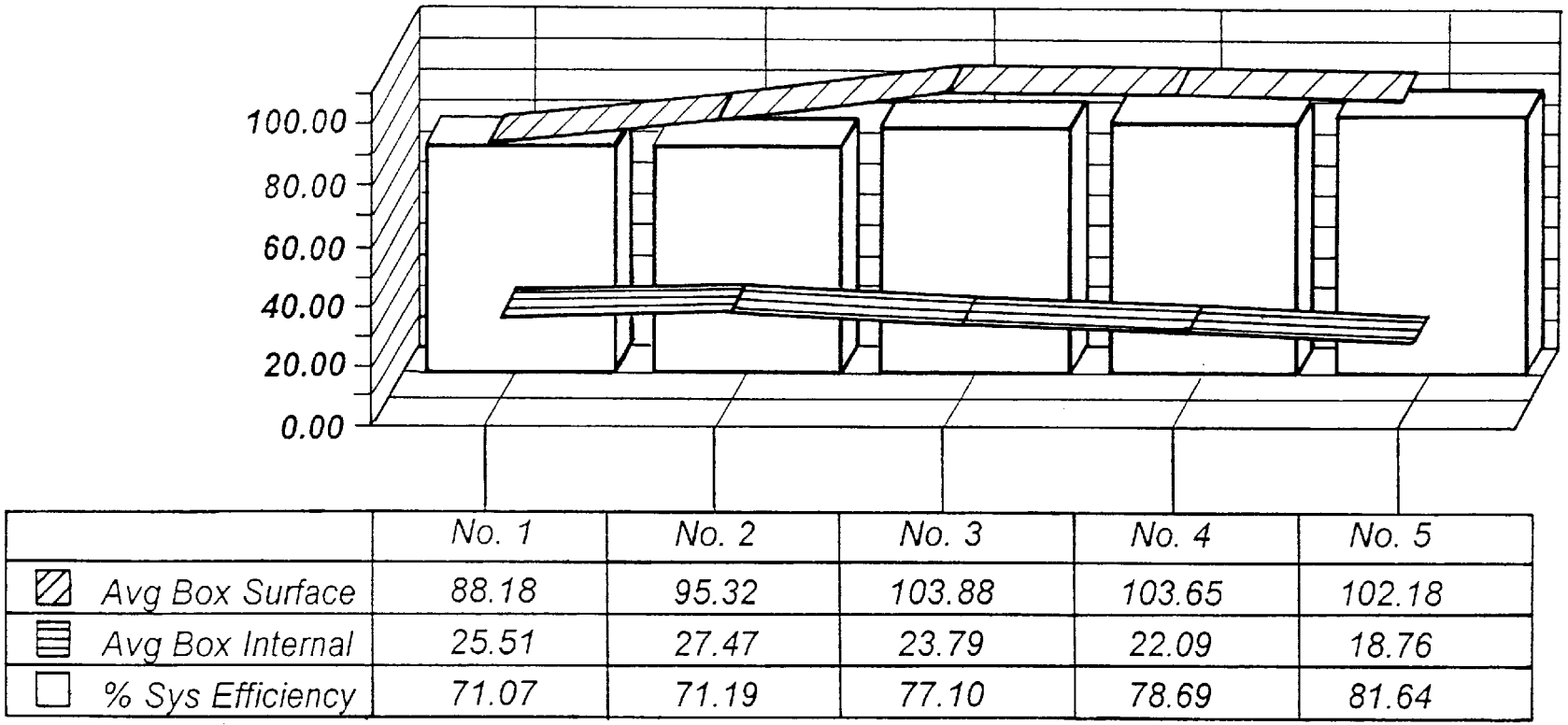
FIG. 10 is a graph detailing the combined test results of a series of five tests run over approximately a week of time in a hot summer month in a deep south town, in which the exterior surface temperature of the box in direct sunlight is graphed against the protected interior of the box over a six hour period, providing an analysis of the system's percent efficiency achieved with embodiments of the present invention.

Further, exemplary variants for the groceries packing for the bubble wrap include:

1. A single sheet of bubble wrap 140 laid in the bottom of the corrugated box 100 before loading the "Therma- Freeze" sheet material and groceries in. The presence of the bottom layer of bubble wrap tends to slow conductive heat that attacks the bottom of the box from, for example, a concrete or asphalt patio or walkway if the groceries are left in such a location. This configuration has been tested, and the results are shown in the graph of FIG. 10 as the last test (Test No. 5).

2. Along the same protection approach, using bubble wrap 140 around the sides and top of the grocery "payload" (between the walls of the corrugated box 100 and the groceries), in addition to the sheet laid in the bottom, should likewise be effective and is illustrated, for example, in FIG. 4, especially for longer delivery time frames such as, for example, eight (8) hours.
3. Again, along the same approach, using bubble wrap (140) laminated to the inside of the corrugated box 100 as a standard by a box manufacturer should also be effective and such a box, it is believed, is unique.

As previously noted, when the bubble wrap (140) is used, preferably it is applied with the bubbles of the wrap facing the corrugated box wall 101 (note FIG. 8) rather than facing towards the "payload" zone. The reason is to double or Qtherwise increase the volume of trapped air between the corrugated box and the "payload" by trapping the air between the bubbles against the box wall. The trapped air provides a good thermal barrier against conducted heat. (An exception to this is when the ambient temperature is extremely low and a heated (or unheated but hydrated) "pouch" of packet material is used within the bubble wrap layered box to counter or absorb the ambient cold, in which case the bubble wrap is placed preferably with the bubble side toward the box interior, that is, toward the outer surface of the exterior pouch of packet material.)

In the foregoing, the primary application has been keeping perishables cold with the various elements or components described, with the perishables involved being in many forms (primarily foods, but also applicable to pharmaceuticals, medicines, organ transplants, confections, floral related products, etc.) with perishable grocery delivery as the primary example. However, it should be understood that the principles of the invention are also applicable to the extreme problem of delivering groceries (or other perishable goods) in overly cold environments, such as, for example, in Duluth, Minn. in February. In such a situation, the normally refrigerated, perishable groceries (milk, eggs, cheese, lunch meat, etc.) need to be protected from becoming too cold and for example, from freezing into a solid mass.

This is a tougher challenge, as the cool groceries must be kept at acceptable refrigerator temperatures for non-frozen, perishable groceries 120' such as milk, eggs, orange juice, etc. [e.g., above about 30–33 degrees F. (comparable to a cold refrigerator) up to about 40–45 degrees F. (comparable to a warm refrigerator)] with a temperature affecting, warming device in ambient conditions that can get as extremely low as, for example, −30 degrees F. wind chill. Thus, the packaging of the fragile groceries being delivered must keep the perishables from getting much above about 45 degrees F., while also maintaining them above about 30–33 degrees F. (or above a lower temperature depending on the particular perishable involved). To effectively serve as a low temperature minim, the packet material need not necessarily be heated and, for example, by just using hydrated, but neither initially frozen nor heated, packet material, the hydrated packet material can serve as a cold-absorbing, thermal barrier, which, until the super-absorbent polymer 14 of the packet material itself freezes, the contained temperature sensitive, perishable goods stay at a safe, acceptable temperature for the perishables.

Figure 4:
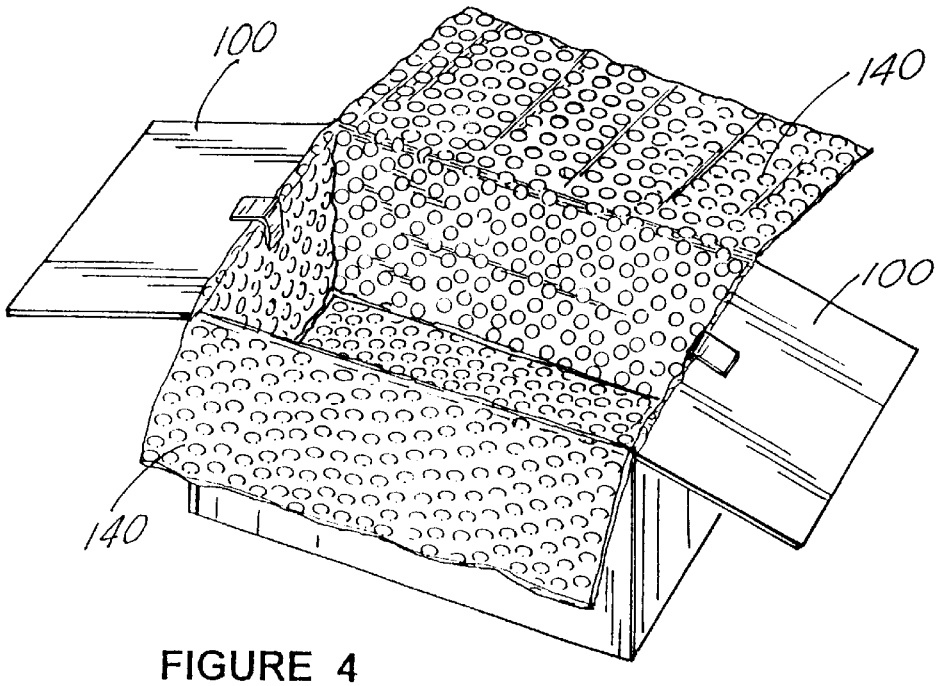
FIG. 4 is a top, perspective view of an outer, cardboard container box for inter alia the cold wrapped and pouched, frozen perishable grocery item (e.g. ice cream) of FIGS. 2 & 3 (not illustrated in this figure in order to more clearly show the interior of the box), which further includes an interior layer of bubble wrap material, as used in the preferred embodiment of the system of the present invention.

In such a situation preferably a corrugated box 100 lined with bubble wrap 140, such as that illustrated in FIG. 4, is used. The bubble wrap 140 helps keep heat inside the box 100, this time by delaying thermal transfer via conductive heat. Preferably inside the bubble wrap 140 is a layer of heated "ThermaFreeze" packet material 110*a* (10; in similar fashion to the arrangement shown in FIG. 6), which has been hydrated and heated in, for example, a microwave oven. Thus, the packet material is heated to, for example, over 100 degrees F. just before it is to be used. Inside the layer of "ThermaFreeze" preferably is a second layer of bubble wrap (140) that slows the heat from the heated packet material from being conducted directly into the perishable food groceries. In this case, the bubble side of the bubble wrap (140) preferably is applied with the bubbles against the "ThermaFreeze"® material.

Figure 8:
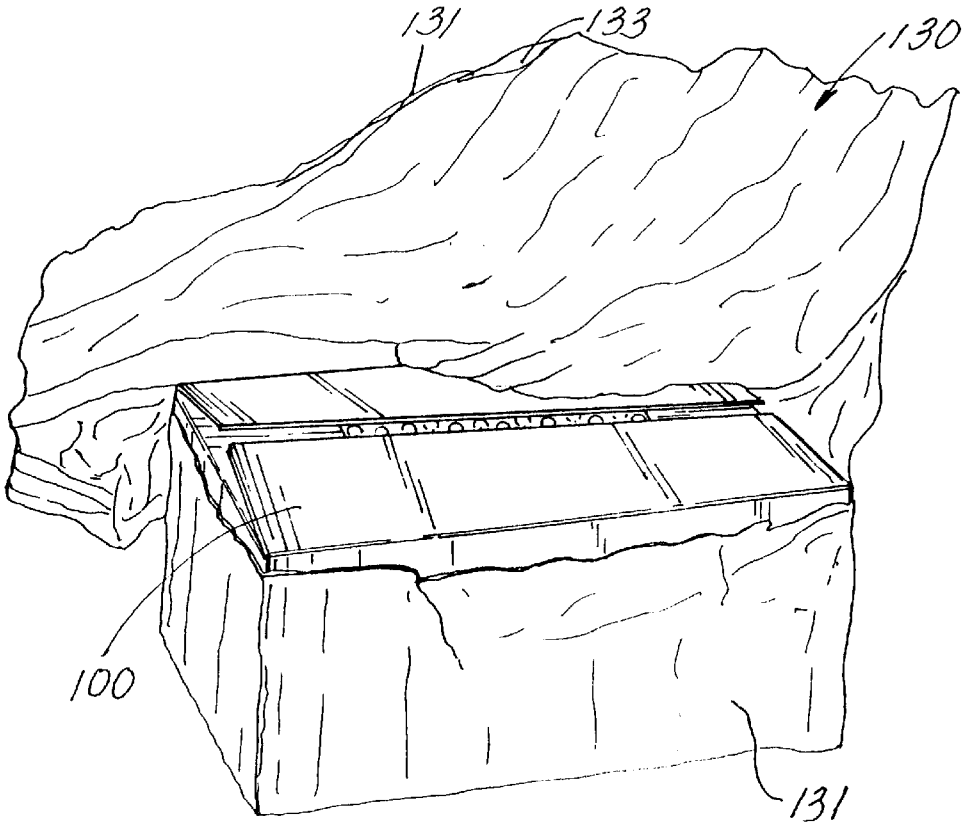
FIG. 8 is atop, perspective view of the elements of FIG. 7, but with the top flaps of the box folded over and with the packed box inserted into an outer, pouch, forming an outer cover, with the top of the pouch being pulled over the top of the box, as used in the preferred embodiment of the system of the present invention.

Once the box 100 is packed and sealed, preferably a black heavy gage plastic film cover preferably made of polyethylene (comparable to cover 130 but without the metallized film 131) is used to cover the entire box 100, in similar fashion to that illustrated in FIGS. 8 & 9. The gage of the film will be similar to the metallized film 131 described above. Like the metallized film cover 130 used for pure cooling applications, the black cover for the heating application preferably is constructed with a closing lip having a two-sided, tape sealing mechanism in like fashion to the tape 133.

Like the pure cooling applications, the heating application is subject to many variations in configurations and combinations.

Figure 1:
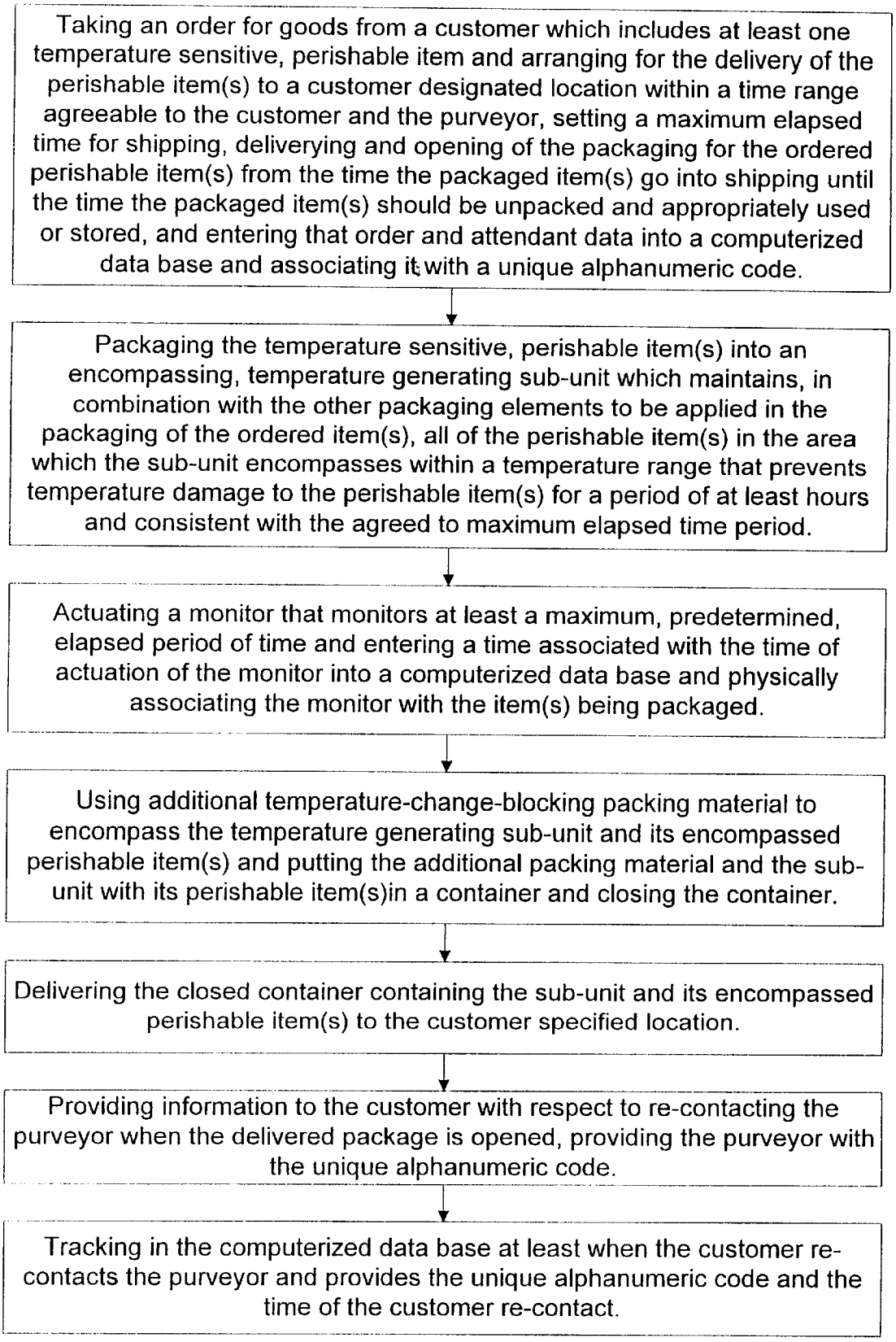
FIG. 1 is a flow chart summarizing the preferred methodology and algorithms of the preferred embodiment of the present invention.

Preferred Methodology Summary (FIG. 1)

As is summarized in FIG. 1, in the beginning (200) of the methodology, a customer places an order for groceries with the purveyor, typically using either a telephone call or a visit to an Internet site (201). If the order includes perishable items (202A), the customer preferably is informed of the special time of delivery arrangements (as agreeable with the customer) and calling arrangements that must be followed for the perishable groceries to be warranted by the purveyor to be in proper condition (203) when unpacked and placed in the customer's refrigerator/freezer. If there are no perishable items being ordered, the delivery arrangements follow the usual, temperature unprotective procedures (202B).

For perishable goods that are ordered, preferably the system's calculator analyzes the perishable goods in the order (204) and specifies for the purveyor's shipping department the proper packing procedure and protective elements to be used in packing the shipment for delivery (205). Based on the agreed to delivery time range and the availability of transportation, the ordered groceries are assembled for delivery (206), and the delivery department packages the ordered groceries in accordance with the calculator's instructions (207), unless over-ridden by appropriate supervisory personnel (208).

When the ordered groceries have been appropriately packed in the appropriate temperature protective way, the time of completion is noted and entered in the purveyor's computerized data base system (210), the covered box 103/100 is sealed (211), inter alia the transaction tracking number is printed on the card 135 (212) and the card attached to the top of the covered box (213). The elapsed time monitor 134A is activated to track at least the maximum allowed time for the box 100 to be opened and attached to the exterior of the closed and sealed box. If both the maximum temperature and the maximum allowed elapsed time are to be monitored, as is preferred, either two different monitors can be used, with the elapsed time monitor 134 being attached to the exterior of the closed and sealed box 130/100 and the maximum-temperature-allowed monitor placed on top of the perishable goods (120/120'), or, alternatively and as preferred, a combined maximum temperature and maximum elapsed time monitor 135 could be used and placed with the perishable goods in the stage represented in FIG. 5 (209).

The sealed, covered box 130/100 is then turned over to the purveyor's transportation or delivery department (214) and the sealed, covered box is delivered to the customer's designated delivery location (215) and the time of delivery noted and entered into the purveyor's computerized data base (216). This data entry can be immediately entered preferably by, for example, wireless communication (217) or entered when the delivery truck returns to the purveyor's business location, assuming the time of return is consistent with the remaining preferred methodology.

The purveyor's computer tracks the elapsed time of package completion (i.e., the occurrence of step 210 or 211) and the time of delivery (namely, that determined in step 216), and, if the customer does not "call" in or otherwise the timely opening of the covered box 130/100 is not confirmed, the preferred system initiates a customer calling procedure, repetitively calling the customer, for example, every ten (10) minutes for an appropriate period of time (e.g., up to an hour) until contact and an appropriate response is made with respect to the time of opening (and presumed putting away of the perishable goods) of the delivered package.

The use of a tone generating, telephone key pad or an Internet site allows a completely automated data entry system from the purveyor's point of view for the customer's packing opening information.

The time of the determined opening of the box 100 is used to determine whether the perishable goods have been timely handled (217) and, if timely, the perishable goods are effectively warranted (218) and, if not, the warranty lapses (219). In the latter instance the customer, if he or she so desires (220), calls the purveyor and arranges for the pick-up of the now unwarranted, perishable item(s).

The data concerning this transaction is posted to the purveyor's computerized data base for further analysis and possible use in the "calculator" step (221), and the process is completed (222).

Graph of Test Results (FIG. 10)

The graph of FIG. 10 details the combined test results of a series of five tests run over approximately a week in a hot summer month in a deep south town, in which the average, exterior surface temperature (F) of the covered box 130/100 in direct sunlight is graphed in the upper line against the average temperature (F) in the temperature protected interior of the covered box in the lower line, over an exemplary six (6) hour period, while additionally providing an analysis of the system's percent efficiency (shown in the background block elements) achieved with embodiments of the present invention. The packaging elements of the covered box 130/100 were substantively the same throughout the tests, except in Tests No. 1–4 no bubble wrap layer(s) or sheet(s) (140) was/were included between the interior of the box 100 and the six (6) sheets of "ThermaFreeze"® material (10), which material effectively formed the pouch 110*a* shown in FIGS. 5 & 6, while in Test No. 5 a single sheet of bubble wrap (140) material was included on the bottom of the box 100, generally as shown in FIG. 4, but without the illustrated four (4) side sheets or top sheet of bubble wrap material. Another variant was that in Tests Nos. 1 & 2, the covered box 130/100 was sitting on a pallet, while in Test Nos. 3–5 the covered box was sitting directly on an exposed concrete surface.

As can be seen in the graph, the average surface temperature from direct sunlight ranged from 88.18 degrees F. to 102.18 degrees F., while the average temperature of the temperature protected interior ranged from 25.51 degrees F. to 18.76 degrees F., temperatures well low enough (and then some) to protect evenly highly temperature sensitive food items such as, for example, frozen ice cream (120).

Figure 6:
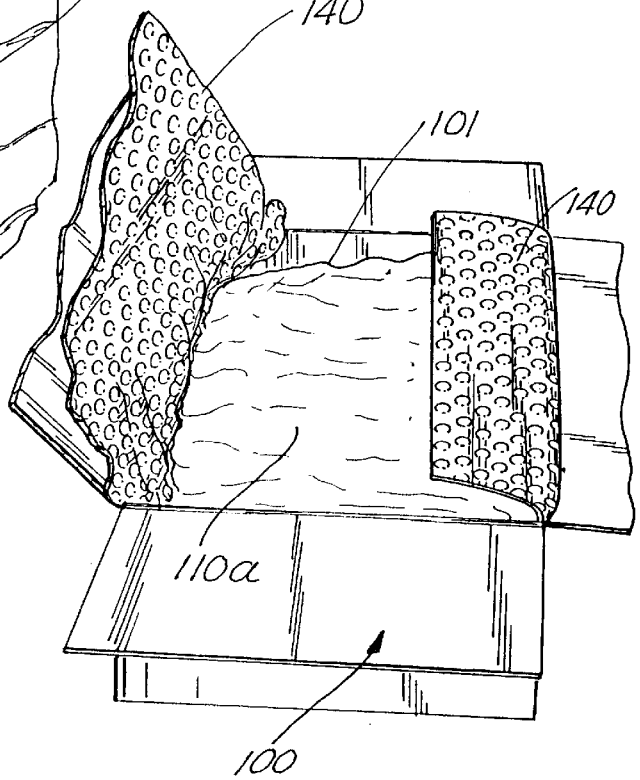
FIG. 6 is atop, perspective view of the elements of FIG. 5, but with the top of the all-encompassing pouch of hydrated, frozen packet material being folded over, topping off the contained grocery items and with part of the box interior's bubble wrap being partially folded over, as used in the preferred embodiment of the system of the present invention.
Figure 7:
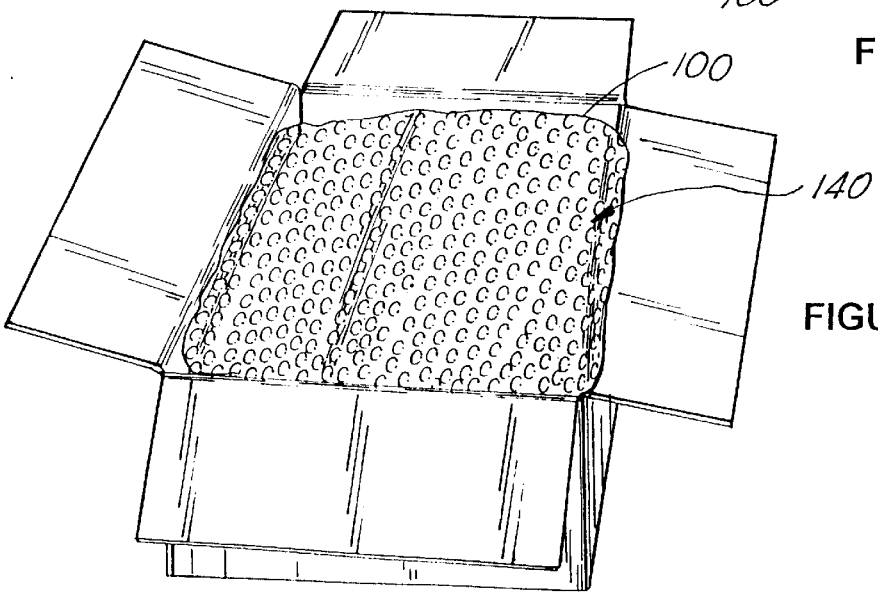
FIG. 7 is atop, perspective view of the elements of FIG. 6, but with the top of the box interior's bubble wrap being fully folded over, as used in the preferred embodiment of the system of the present invention.

Of course, with the additional sheets of bubble wrap (104), effectively forming an enclosing pouch 104 as shown in FIGS. 4, 6 & 7, as well as other variants and additions to the interior packing elements, the test results would be even better. Protective periods of eight (8) hours have been achieved and even longer times of protection are expected.

Preferred "ThermaFreeze" Packet Sheet Material (FIGS. 11–15)

Figure 11:
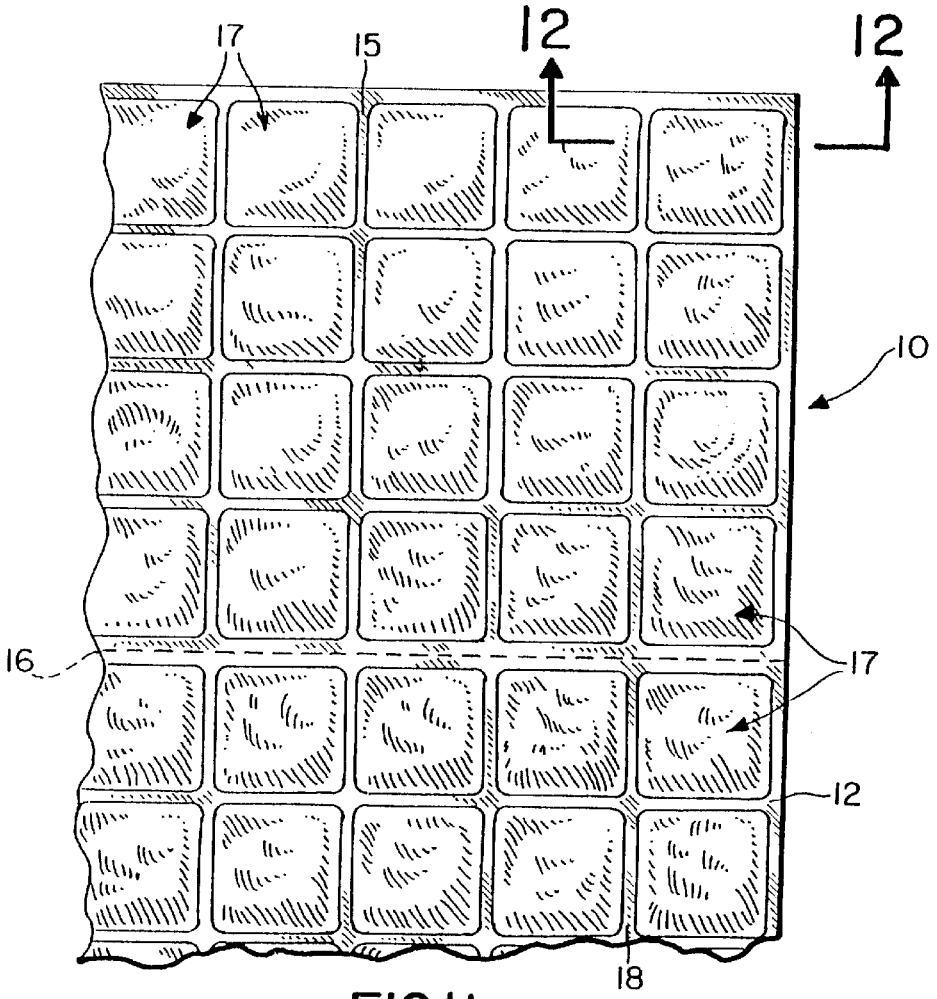
FIG. 11 is a plan view of the exemplary, preferred embodiment of the finished hydratable packet pad or sheet preferably used in the preferred methodology of the present invention.
Figure 12:
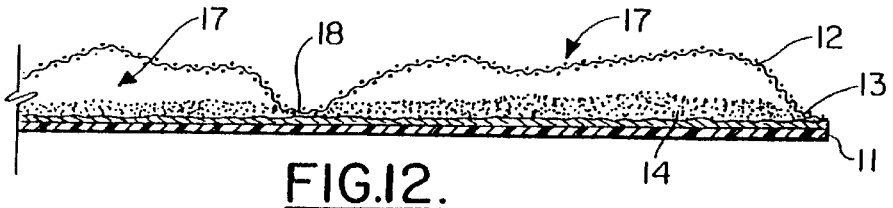
Figure 12A:
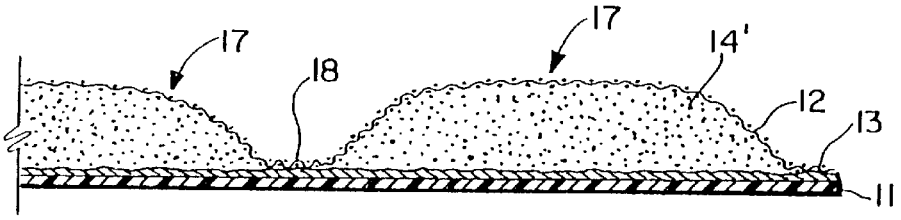
FIG. 12A is similar to FIG. 12 but with the packet sheet having been hydrated, with the super-absorbent polymer having super-absorbed the water and having been frozen ready for end use, it being noted that these figures are not construction or "to-scale" drawings but rather generalized ones, as is typical of patent application drawings.
Figure 13:
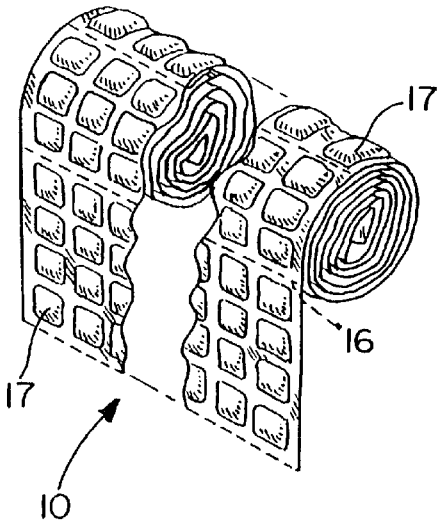
FIG. 13 is a perspective view of the packet sheet of FIG. 11 in roll form as provided, for example, to the end industrial user, e.g. the perishable groceries purveyor.

As can be seen in FIGS. 11–13, the preferred, exemplary embodiment of the hydratable sheet packet material 110 of the present invention comprises an extended sheet 10 of packets made up of a backing sheet 11, preferably of an impervious plastic sheet material (such as, for example, polyester film), and an upper, porous sheet 12 (such as, for example, non-woven polypropylene with no additives), with a preferably tacky, sealant or adhesive layer 13 [e.g. 22.5% ethylene-methyl-acrylate (EMA)], about one mil (0.0001") thick (or equivalently 14.4 lbs. per ream of the finished sheet material), used to affix and seal the two sheets 11 & 12 together along longitudinally and laterally extending lines 15 & 16, respectively, defining a series of cells 17 with the cells effectively joined by the flat areas 18 between adjacent cells.

Contained within each cell 17 of the packet sheet 10 is an appropriate amount of super-absorbent, polymer 14. As can be seen in FIG. 12, the polymer powder 14 initially occupies only a small amount [perhaps about fifteen (15%) percent] of the total interior volume of the cell 17. This allows room for the approximately ten (10) fold expansion which occurs as the polymer 14 is hydrated by being soaked in water, which the polymer superbly absorbs, and the hydrated polymer ultimately frozen. As shown in FIG. 2A, in this hydrated state, the hydrated polymer 14 expands and fills out the interior of the cell 17.

Additionally, when the polymer powder 14 is initially deposited on the film sheet 11 with its tacky adhesive layer 13, it is deposited in the area destined to be made into a cell (17) basically in the form of a circular cone, preferably with a relative wide base in comparison to its height, for example, in a circular cone having a base with a diameter of three-quarters of an inch (¾") and a height of a quarter (¼") inch, with these preferred dimensions having a ratio of three-to-one (3:1). For enhanced polymer pile stability, it is believed that the minimum ratio should be at least about two-to-one (2:1).

This provides a relatively stable, conglomerated pile, with a substantial amount of the powder 14 in contact with the tacky adhesive layer, substantially stabilizing to some degree all of the polymer powder on the film 11. As a result, the entire pile is much more stable, resulting in little or no loss of powder outside of the cell area 17 as the film 13 with the polymer powder 14 on it moves to the heat/pressure sealing rollers.

The polymer 14 preferably is multiply-cross-linked and preferably contains no alcohol, such as, for example, double-cross-linked sodium polyacrylate polymer, such as that of Stockhausen, Inc.'s "AP88" super-absorbent polymer, preferably in powder or particulate form.

"AP88" is a double-cross-linked, sodium polyacrylate that contains no alcohol component and more particularly no poly-alcohols. Stockhausen Inc. is located at 2401 Doyle St., Greensboro, N.C. 27406. In contrast, the absorbent material used in the 1994, prior art packet cell was Stockhausen's "FAVOR® SAB 800," a super-absorbent polymer with a chemical basis of a salt of cross-linked polyacrylic acid/polyalcohol grafted copolymer, which material in only singly cross-linked and contains polyalcohol with a number of alcohol (OH) functional groups.

The use of a double-cross-linked or higher (2+) cross-linked polymer for the super-absorbent material 14 provides a much more effective product which is able to contain fluids, such as the product's hydration water. Additionally, the use of a super-absorbent polymer which does not contain any alcohol functional groups, particularly any polyalcohols, provides for a more stable, safer product due in part to the absence of the volatility and combustibility such polyalcohol polymers typically have. As a result of the double-cross-linking of the super-absorbent material 14, the packet cells contain and hold the hydration water longer, slowing the thawing process, producing the greater than eight-to-one (>8:1) advantage the preferred embodiment of the invention has over the 1994 product and is highly pressure resistant.

It is noted that the embodiment of the packet sheet material 10 described in detail for exemplary purposes is of course subject to many different variations in structure, design, application and methodology. For further examples, the adhesive layer could be added only where the polymer powder is to be placed and not in the sealed, cell surrounding areas 18, although it is currently preferred to have the adhesive layer cover the entire surface of the backing film, as described above. Likewise, water permeable material could be used for both sheets of material (11 & 12), if so desired, or the water permeable material could be used only in the areas where the super-absorbent polymer is located or only in part(s) thereof, although again the embodiment described in detail above is currently preferred. Also, the adhesive layer could be put on both sheets of material or only the permeable one, but again the embodiment illustrated and described in detail in connection with FIGS. 11–13 is currently preferred.

Additional details on this preferred temperature affecting source 10 (either coldness or heat) is provided in co-pending patent application Ser. No. 09/079,872, referred to above.

It is noted that the embodiments described herein in detail in connection with FIGS. 1–9 for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A delivery system for temperature sensitive, perishable goods, including at least one temperature sensitive, perishable item, by a purveyor of the goods, comprising the following steps:

a) taking an order for goods from a customer which includes an order for at least the one temperature sensitive, perishable item and arranging for the delivery of the perishable item to a customer designated location within a time range agreeable to the customer and the purveyor, setting a maximum elapsed time for shipping, delivery and opening of the packaging for the ordered perishable item from the time the packaged item goes into shipping until the time the packaged item should be unpacked and appropriately used or stored, and entering that order and attendant data into a computerized data base and associating it with a unique alphanumeric code;

b) after step "a" packaging the temperature sensitive, perishable item into an encompassing, temperature generating sub-unit, along with additional, temperature change-blocking packing material, which sub-unit maintains, in combination with the other packaging material to be applied in the packaging of the ordered item, the perishable item in the area which the sub-unit encompasses within a temperature range that prevents temperature damage to the perishable item for a period of hours and consistent with the agreed to maximum elapsed time period;

c) actuating a monitor that monitors at least a maximum, predetermined, elapsed period of time and entering a time associated with the time of actuation of the monitor into the computerized data base and physically associating the monitor with the item being packaged;

d) after steps "a" & "b" using the additional temperature-change-blocking packing material to encompass the temperature generating sub-unit and its encompassed perishable item and putting the additional packing material and the sub-unit with its perishable item in a container and closing the container;

e) delivering the closed container containing the sub-unit and its encompassed perishable item to the customer specified location;

f) providing information to the customer with respect to re-contacting the purveyor when the delivered package is opened, providing the purveyor with the unique alphanumeric code; and g) tracking in the computerized data base at least when the customer re-contacts the purveyor and provides the unique alphanumeric code and the time of the customer re-contact.

2. The delivery method of claim 1, wherein there is further included in connection with step "c" the further step of:

evaluating the amount of time that has elapsed since the performance of either step "c" or step "d"; and in connection with step "g" the further step of:

tracking in connection with the computerized data base whether the customer has confirmed the delivery and opening of the packaged item in a timely manner, and, if not, actuating a repetitive customer contacting telephone calling system to remind the customer with a pre-recorded message of the need to confirm when the delivered package has been opened, which calling system is repeated every few minutes until a successful contact has been made or until the maximum elapsed time limit has been exceeded.

3. The delivery method of claim 1, wherein the customer's order includes both frozen and refrigerated perishable items, including at least one ordered frozen item and at least one ordered refrigerated item, and wherein there is further included in connection with steps "b" and "d" the steps of:

individually packaging the frozen item within a temperature generating encompassing sub-unit; and collectively packaging the combined refrigerated item and the individually packaged frozen item into a second, collectively encompassing, temperature generating sub-unit.

4. The delivery method of claim 3, wherein in connection with the individualized packaging of the frozen item there is included the further step of:

inserting the packaged sub-unit with its encompassed frozen item into an individualized pouch of multiply material, in which one ply is bubble wrap.

5. The delivery method of claim 1, wherein there is included between steps "a" and "b" the step of:

using in connection with the computerized data base test and historical data to evaluate the ordered perishable item and, by calculation, predict the needed form and amount of temperature generating material to safely pack and deliver the ordered perishable item in the agreed to maximum elapsed time and within a safe temperature range for the ordered perishable item.

6. The delivery method of claim 5, wherein there is further included the step of using the calculations done in the steps of claim 5 to guide the purveyor's shipping personnel in packaging the ordered perishable items.

7. The delivery method of claim 1, wherein there is included in connection with steps "c" & "d" the step of:

including the monitor with the container and including with the monitor instructions for the customer in performing step "f."

8. The delivery method of claim 1, wherein there is included in connection with step "c" the step of:

monitoring with a single monitor both the maximum elapsed time as well as the passing of a maximum allowed temperature; and wherein there is included before step "d" the step of:

placing the single monitor in with the perishable item within the inside of the container before it is closed.

9. The delivery method of claim 8, wherein there is further included in connection with the steps of claim 8, the step of:

including with the single monitor printed instructions for the customer in performing step "f."

10. The delivery method of claim 1, wherein the customer's order includes both frozen and refrigerated perishable items, including at least one ordered frozen item and multiple ordered refrigerated item, and wherein there is further included in steps "b" and "d" the steps of:

individually packaging the frozen item within a temperature generating encompassing sub-unit; and collectively packaging the combined refrigerated items and the individually packaged frozen item into a second, collectively encompassing, temperature generating sub-unit.

11. The delivery method of claim 1, wherein in connection with steps "b" and "d" there is included the step of:

using a corrugated cardboard box for the container.

12. The delivery method of claim 11, wherein in connection with steps "b" and "d" there is included the step of:

using with the corrugated cardboard box an interior lining of bubble wrap material for the container.

13. The delivery method of claim 1, wherein in connection with step "d" there is included the step of:

placing a flexible cover of water-retardant material completely around the container.

14. The delivery method of claim 13, wherein in connection with step "d" there is included the step of:

sealing the flexible cover of water-retardant material completely around the container using reusable, adhesive tape.

15. The delivery method of claim 13, wherein in connection with step "d" there is included the step of:

sealing the flexible cover of water-retardant material completely around the container using reusable, "hook and loop" fastening material.

16. The delivery method of claim 1, wherein the ordered perishable item includes at least one non-frozen, refrigerated item, and wherein the ordered item is to be delivered in an extremely low ambient temperature, below zero degrees F., and wherein in connection with steps "b" and "d" there is included the steps of:

surroundingly encompassing the sub-unit with its perishable, non-frozen, refrigerated item within it in a material containing a number of surrounding packets having super-absorbent, hydrated polymer contained therein and using it as a barrier to prevent the cold temperature of the extremely cold ambient from freezing the non-frozen, refrigerated perishable item with the encompassed sub-unit providing a source of cold maintaining the perishable item for at least the agreed to maximum elapsed period of time, while the hydrated packet material prevents the cold temperature of the extremely cold ambient from freezing the refrigerated perishable item.

17. The delivery method of claim 16, wherein, in further connection with step "d" and in connection with the steps of claim 16, there is included the further step of:

heating the hydrated packet material before surrounding it around the sub-unit.

18. The delivery method of claim 17, wherein the sub-unit has outer surfaces, and wherein, in further connection with step "d" and in connection with the steps of claim 17, there is included the further step of:

effectively placing a heat barrier layer between the hydrated packet material and the outer surfaces of the sub-unit preventing the heat from the heated hydrated packet material from being substantially transferred to the surrounded sub-unit.

19. The delivery method of claim 1, wherein there is included the further step of:

using as part of the packaging material a multiply material, in which a first ply is a temperature-change-blocking, foam material.

20. The delivery method of claim 19, wherein there is included the further step of:

using as part of the packaging material the multi-ply material of claim 19 having a second ply of a metallized material.

21. The delivery method of claim 20, wherein there is included the further step of:

using as part of the packaging material the multi-ply material of claim 20 having a third ply of bubble wrap.

* * * * *